United States Patent [19]

Jepsen

[11] Patent Number: 5,060,316

[45] Date of Patent: Oct. 29, 1991

[54] SCARF SUPPORT

[76] Inventor: Donna Jepsen, 307 Sixth St., Durant, Iowa 52747

[21] Appl. No.: 635,811

[22] Filed: Jan. 2, 1991

Related U.S. Application Data

[63] Continuation of Ser. No. 377,384, Jul. 10, 1989, abandoned.

[51] Int. Cl.[5] ..... A41F 9/00

[52] U.S. Cl. ..... 2/338

[58] Field of Search ..... 2/338, 311, 312, 318, 2/319, 320, 321, 206, 207, 244, 114

[56] References Cited

U.S. PATENT DOCUMENTS

| | | | |
|---|---|---|---|
| 544,596 | 8/1895 | Simmons et al. | 2/320 |
| 636,149 | 10/1899 | Kinsey | 2/320 |
| 2,123,773 | 7/1938 | Eppink | 2/244 |
| 3,093,830 | 6/1963 | Wills . | |
| 3,261,025 | 7/1966 | Simek | 2/207 |
| 3,517,395 | 6/1970 | Shimoi . | |
| 3,737,917 | 6/1973 | Orr . | |
| 4,104,739 | 8/1978 | Burger . | |
| 4,370,782 | 2/1983 | Aronica | 2/114 X |
| 4,520,536 | 6/1985 | Hata | 2/320 X |

FOREIGN PATENT DOCUMENTS

| | | | |
|---|---|---|---|
| 1118544 | 3/1958 | France | 2/244 |
| 18362 | of 1900 | United Kingdom | 2/319 |
| 8886 | of 1907 | United Kingdom | 2/319 |
| 811084 | 4/1959 | United Kingdom | 2/207 |

OTHER PUBLICATIONS

Plastic shirt packaging device which fits over the top button and beneath the shirt collar.

*Primary Examiner*—Daniel P. Stodola
*Assistant Examiner*—John P. Darling
*Attorney, Agent, or Firm*—Henderson & Sturm

[57] ABSTRACT

A support for scarves. An elongated flexible support body (12) has smoothly curved end edges (15) and a centrally disposed slot (16) forming a tab area (20). A scarf is engaged and anchored by the tab area and wrapped around the support body. The supported scarf then can be employed as a belt while retaining a fully decorative display for extended periods of wearing.

2 Claims, 1 Drawing Sheet

Fig. 6
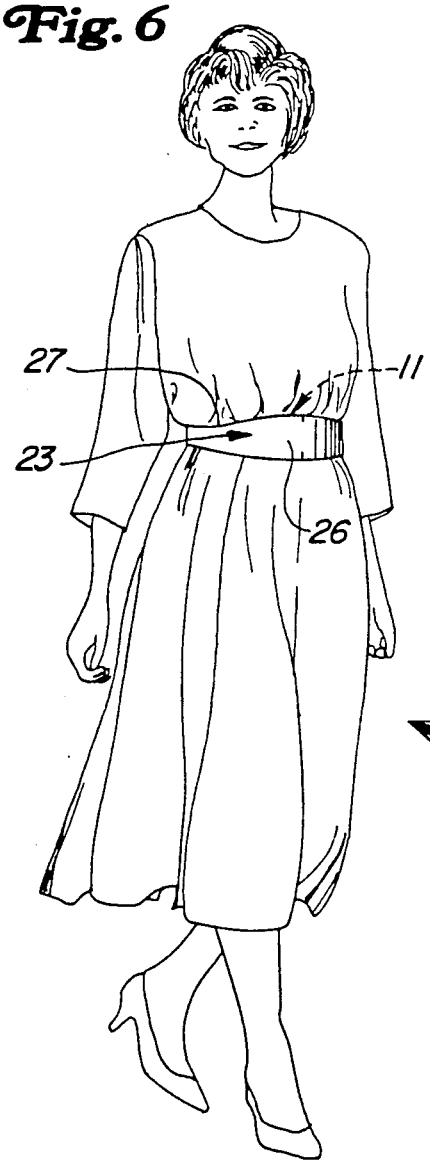
Fig. 1
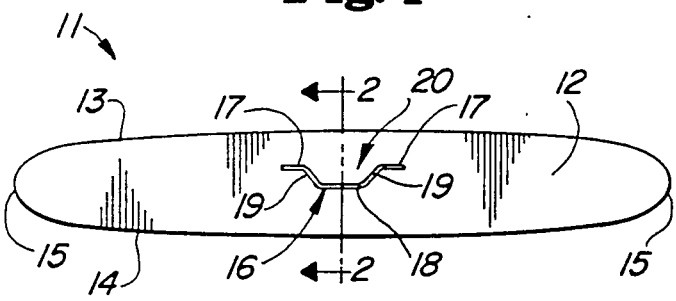
Fig. 3
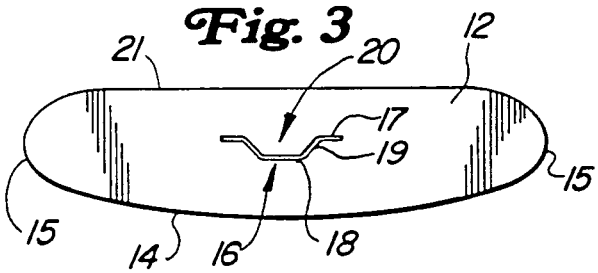
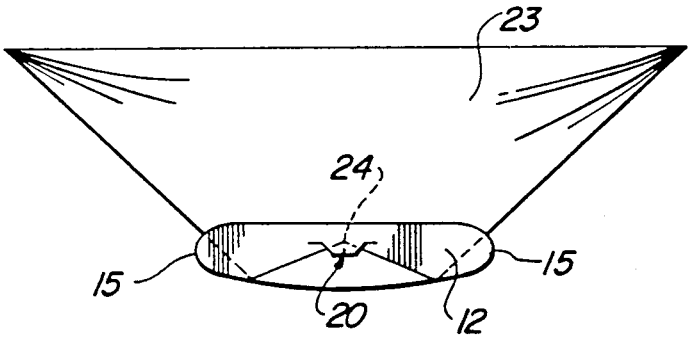
Fig. 4
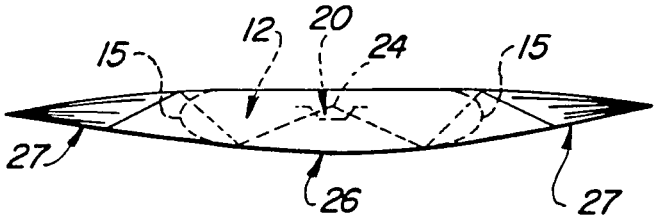
Fig. 5
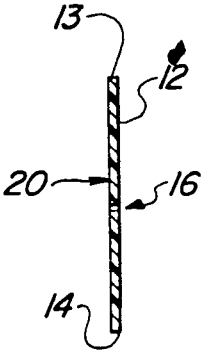
Fig. 2

SCARF SUPPORT

This is a continuation of copending application Ser. No. 377,384, filed July 10, 1989, now abandoned.

TECHNICAL FIELD

This invention relates generally to fashion accessories. More particularly the invention relates to scarves and apparatus for shaping a scarf in a desired fashion.

BACKGROUND ART

Accessories generally are employed to enliven wardrobes, to increase the number or variety of "looks" the wearer can attain with a fixed wardrobe. Scarves traditionally are employed about the neck of the wearer. For a different look they have been employed in place of a belt; however, in such cases, the scarf generally wads or clumps up, losing much of its decorative effect, in a very short time.

DISCLOSURE OF INVENTION

Responding to the need described above, this invention provides a support having an elongated body with a centrally disposed slot. The edges of the body are smoothly curved. The slot forms a smoothly curved tab. A scarf is engaged and anchored by the tab, then wrapped about the support body. The supported scarf then is tied about the waist of the wearer.

It is an object of this invention to provide an apparatus for extending the number of "looks" one may obtain from a fixed wardrobe by increasing the number of ways certain accessories may be employed. More specifically, it is an object of this invention to provide an apparatus for extending and varying the use to which a scarf may be put.

Another object is to facilitate usage of scarves as belts while maintaining the decorative effect of the scarves. Yet another object is to enable employment of a scarf as a decorative belt while minimizing the possibility of snagging and tearing of the scarf.

A further object of this invention is to provide an apparatus which is relatively inexpensive to fabricate. It is of sturdy construction and capable of achieving the afore-mentioned objects.

These objects and other features and advantages of the scarf support invention will become readily apparent upon referring to the following description in conjunction with the appended drawings.

BRIEF DESCRIPTION OF THE DRAWINGS

The scarf support invention is illustrated in the drawings wherein:

FIG. 1 is a front elevational view of the scarf support;

FIG. 2 is an enlarged, transverse sectional view taken along line 2—2 of FIG. 1;

FIG. 3 is a front elevational view of another configuration of the scarf support;

FIG. 4 is a reduced front elevational view showing initial engagement of a scarf by the scarf support of FIG. 3;

FIG. 5 is a reduced front elevational view showing wrapping of the scarf about the scarf support; and FIG. 6 is a perspective view of a user employing a scarf with scarf support.

BEST MODE FOR CARRYING OUT THE INVENTION

The scarf support invention is shown generally at (11) in FIG. 1. The support (11) includes an elongated main body (12), having top and bottom longitudinal edges (13), (14) connected by opposite end edges (15). The top and bottom edges (13), (14) are most widely spaced apart at the central transverse axis of the body (12) and smoothly taper toward each other as they extend in each direction toward the end edges (15). The end edges (15) are smoothly rounded.

A generally centrally disposed slot (16) is formed through the body (12). The slot (16) includes relatively straight end sections (17) disposed generally parallel to the central longitudinal axis of body (12) and between said axis and edge (13). The sections (17) are uniformly spaced to each side of the central transverse axis of the body (12). An intermediate curve section (18) is disposed between the central longitudinal axis of body (12) and the bottom edge (14) and crosses the central transverse axis of the body (12). Smoothly curved lengths (19) connect the sections (17), (18). A scarf engaging tab area (20) is defined by the sections (18), (19).

An alternate form of the scarf support invention (11) is shown at FIG. 3. The top edge (21) remains substantially straight and parallel to the central longitudinal axis of body (12). Some overall tapering is effected by the bottom edge (14) as before.

The body (12) is formed of plastic and has a thickness which allows for flexibility yet provides enough rigidity for the desired support. A thickness of approximately one-sixteenth of an inch has been found to be satisfactory. The body (12) with slot (16) is formed from plastic blanks by using dies and techniques well known to those skilled in the art.

Referring now to FIG. 4 for use of the support (11) a scarf (23) first is folded along a diagonal axis thereby bringing two corners together, as at (24). The paired corners (24) are inserted through slot (16) until the paired corners extend through the entire lengths of section (17), (18), (19) and engage the ends of sections (17). The body (12) then is rotated, the tab area (20) engaging and keeping the scarf (23) anchored. Rotation is continued until the scarf (23) is completely wound around the body (12), as shown in FIG. 5, to form a supported display area (26) and tie portions (27) extending from each end of said area (26).

The scarf (23) then can be tied around the waist of the user as shown in FIG. 6. The support (11) bends to conform to the waist of the wearer and is disposed to the front of the wearer. The surface of the supported display area (26) remains relatively flat or smooth during wearing, thereby effectively performing its decorative display function for substantially the entire time worn. The support (11) enables the wearer to use scarves in other than standard ways, thereby extending the variety of appearances obtainable from the wearer's wardrobe. More specifically, the support (11) enhances usage of scarves as belts, and due to the curvature of the slot (16) and the edges (15), snagging and tearing, even of loose weave scarves is minimized while doing so.

The industrial applicability of this scarf support invention is believed to be apparent from the foregoing description. Although a preferred embodiment and modification thereof have been disclosed herein, it is to be remembered that various alternate constructions can be made thereto without departing from the scope of the invention.

I claim:

1. A scarf support for use in combination with a scarf dimensioned to encircle the waist of a user to prevent wrinkles in the scarf when wrapped around the support wherein the support comprises an elongated flat main body having an enlarged central portion and generally tapered rounded ends; wherein, the enlarged central portion is provided with a generally elongated U-shaped slot centrally disposed therein; and, wherein, the main body has longitudinal top and bottom edges; and, wherein the length and width of the main body are dimensioned to cover a substantial portion of the front of the users midriff; such that when a scarf is operatively engaged in the said slot and snugly wrapped around the entire main body in an enveloping fashion, the main body will be completely covered by the scarf while the spaced top and bottom longitudinal edges of the main body will maintain the external surface of the scarf in a generally smooth and flat disposition at least over the central portion of the wrapped scarf; and across the said substantial portion of the users midriff.

2. The scarf support as in claim 1; wherein said elongated flat main body has a quasi-oval configuration.

* * * * *